US008383847B2

(12) United States Patent
Rao et al.

(10) Patent No.: US 8,383,847 B2
(45) Date of Patent: Feb. 26, 2013

(54) PROCESS FOR THE ENRICHMENT OF METHYL RICINOLEATE FROM CASTOR OIL METHYL ESTERS BY LIQUID-LIQUID EXTRACTION

(75) Inventors: Kasturi Venkata Sesha Adinarayana Rao, Andhra Pradesh (IN); Penumarthy Vijayalakshmi, Andhra Pradesh (IN); Badari Narayana Prasad Rachapudi, Andhra Pradesh (IN)

(73) Assignee: Council of Scientific & Industrial Research, New Delhi (IN)

( * ) Notice: Subject to any disclaimer, the term of this patent is extended or adjusted under 35 U.S.C. 154(b) by 66 days.

(21) Appl. No.: 12/920,657

(22) PCT Filed: Oct. 31, 2008

(86) PCT No.: PCT/IN2008/000716

§ 371 (c)(1), (2), (4) Date: Apr. 28, 2011

(87) PCT Pub. No.: WO2009/109985

PCT Pub. Date: Sep. 11, 2009

(65) Prior Publication Data

US 2011/0245524 A1 Oct. 6, 2011

(30) Foreign Application Priority Data

Mar. 5, 2008 (IN) ..... 520/DEL/2008

(51) Int. Cl.
*C11B 7/00* (2006.01)

(52) U.S. Cl. ..... 554/206

(58) Field of Classification Search ..... 554/206
See application file for complete search history.

(56) References Cited

FOREIGN PATENT DOCUMENTS

FR 1023247 A * 3/1953
GB 563481 A * 8/1944

* cited by examiner

*Primary Examiner* — Deborah D Carr
(74) *Attorney, Agent, or Firm* — Ladas & Parry LLP

(57) ABSTRACT

The present invention provides a process for the enrichment of methyl ricinoleate from castor oil methyl esters by liquid-liquid extraction (LLE) in presence of refined vegetable oils using an aqueous polar solvent. The invention provides an extraction of methyl ricinoleate by a non-destructive extraction method with good yields (75 to 90%) and purity (95 to 99%). The method consists of mixing castor oil methyl esters in a refined normal vegetable oil (feed) in a suitable proportion and selective extraction of methyl ricinoleate in a non-destructive manner by liquid-liquid extraction using a polar aqueous solvent, followed by de-solventization and drying of the solute to get enriched methyl ricinoleate fraction with good yields. The non-hydroxy fatty acid methyl esters of castor oil methyl esters are retained in the vegetable oil and can be used for the preparation of biodiesel or oelochemicals or reused in the process for the enrichment of methyl ricinoleate after removal of non-hydroxy fatty acid either by distillation under reduced pressure or further by liquid-liquid extraction using pure solvent.

9 Claims, 3 Drawing Sheets

PROCESS FOR THE ENRICHMENT OF METHYL RICINOLEATE FROM CASTOR OIL METHYL ESTERS BY LIQUID-LIQUID EXTRACTION

FIELD OF THE INVENTION

The present invention relates to a process for the enrichment of methyl ricinoleate (MR) from castor oil methyl esters (CME). Particularly, the present invention relates to a process for the extraction of methyl ricinoleate by a non-destructive extraction method with good yields (75 to 90%) and purity (95 to 99%). More particularly, the present invention relates to a process for the enrichment of methyl ricinoleate from castor oil methyl esters by liquid-liquid extraction (LLE) in presence of refined vegetable oils using an aqueous polar solvent.

BACKGROUND OF THE INVENTION

India is the major producer of castor (*Ricinus communis., Euphorbiacea*) oil and is a major exporter of the oil for value addition elsewhere. Castor oil is the only commercial source of unsaturated hydroxy acid (12-hydroxy-cis-9-octadecenoic acid) that is ricinolecic acid to the extent of 85-90% which is the feedstock for many of the useful Industrial chemicals. Castor oil and many of its derivatives are stabilized against oxidation by hydroxyl group which protects the double bond by preventing oxidation and reported to be four times more stable than olive oil. The glycerides of castor oil contains $2/3^{rd}$ of triricinolein and the rest is di- and mono-ricinoleins. The high viscosity and specific gravity of the oil with solubility in alcohol and less solubility in petroleum solvent are added advantages.

Castor oil is used in the manufacture of various products like undecenoic acid and heptaldehyde, hydrogenated castor oil (HCO), dehydrated castor oil (DCO), and its fatty acids, sulfated and sulphonated oil, sebacic acid and 2-octanol, ethoxylated oil, polyurethanes etc. Castor oil is also used in a wide range of cosmetics, toiletries and transparent soaps. Castor oil and its derivatives are also used in lubricating formulations. http://www.castoroil.in/ provides comprehensive resources related to castor plant, castor bean, castor oil, castor derivatives and castor-based oleochemicals. Many of the industrial castor-based chemicals are made either with castor oil/castor fatty acids or its methyl esters as such containing 85-90% ricinoleic content. Enriched ricinoleic content with more hydroxyl value is an added advantage in preparation of many of the useful Industrial chemicals with desired properties.

Attempts made by earlier researchers were not fruitful in enriching ricinoleic content in the castor oil/castor fatty acids to the desired extent. Achaya et al., worked in the fractionation of castor oil by LLE using petroleum ether into triricinolein, diricinolein and monoricinolein there by obtaining ricinoleic acid of enhanced purity with lesser yields. (K. T. Achaya, S. A. Salitore, J. Sci & Ind. Res., 1952, vol 11, 471-474). In another attempt, castor oil was partitioned using acid washed hexane and the resulting triricinoleins were once urea-adducted to remove the bulk of non-hydroxy acids present and re-aducted to give ricinoleic acid of good quality in about 40% yield on the weight of the castor oil taken. {(Subramanyam V. V. R and Achaya K. T., J. Sci. Indust. Res. 20D (1961), 45)}. Another report describes a partition procedure for the preparation of ricinoleic acid of high purity in over 80% yield directly from castor oil fatty acids without the need for isolating triricinolein. {(K. J. Philip, P. Venkatrao and K. T. Achaya, Indian Journal of Technology, vol 1 No. 11 (1963), 427-431)}. The mixed fatty acids of castor oil were partitioned using Gunstone's procedure {(Gunstone, F. D. J. Chem. Soc. (1954), 1611; Bharucha, K. E and Gunstone F. D., J. Chem. Soc., (1957), 610)} between petroleum ether (40-60° C.) and 80% methanol which had been initially equilibrated with each other. The petroleum ether was taken in three separating funnels and the fatty acids added to the first along with methanol, after through shaking and settling the lower methanol layer was passed successively through the other two funnels. The first separating funnel was again extracted with fresh methanol which is then passed through the series. The same was done with two more lots of methanol. Finally the four methanol extracts and the three petroleum extracts were combined and the respective fatty acids isolated and analyzed (K. J. Philips et al. Indian Journal of Technology, vol 1 No. 11 (1963), 427-431)}. Hawke et al., reported that the mixed fatty acids drop rapidly in acid value and acetyl value by estolide formation even on standing for a few days at room temperature. {(Hawke F & Kohll, E. A., J. S. Afr. Chem. Inst., 12 (1959), 1)}. They have recorded that holding the mixed fatty acids at room temperature for 6 weeks caused the acid value to fall from 185.8 to 122.7 and hydroxyl value from 180.8 to 119.6 (Hawke F et al.). It is also reported (K. J. Philips et al. Journal of Technology, vol 1 No. 11 (1963), 427-431)} that the acid value of the extracted sample kept at 0° C. for 5 weeks fell only by 2 units. Attempts to enrich the methyl esters of castor oil failed since these were miscible with hexane in all proportions. (K. J. Philips et al. Journal of Technology, vol 1 No. 11 (1963), 427-431)}. A paper describes the liquid-liquid equilibrium of castor oil+soybean oil+hexane ternary system (Tylisha M. Baber, Dung T. Vu and Carl. T. Lira, J. Chem. Eng. Data 2002, 47 1502-1505) at 298.15 K and reported as promising using hexane because of the significant difference between the castor oil and soybean oil K-ratios. ($Ks>1$ and $Kc<1$). During equilibration, the mixture separated into the β-phase (top, hexane-rich) and α-phase (bottom, oil-rich) containing enriched ricinoleic content. U.S. patent (U.S. Pat. No. 7,097,770 August 2006) describes a solid bed adsorptive process of separating castor oil into two substantially pure triglyceride fractions. The above cited reference works involves castor oil fractionation into triricinolein by way of which an enriched ricinoleic acid may be obtained with lesser yields. The methods where using a mixture of solvents in the fractionation of castor fatty acids resulted not only in low yields but recovery and reuse of solvents is difficult for commercial exploitation and the storage of castor fatty acids is difficult due to estolide formation.

Earlier a semi continuous liquid-liquid extractor, FIG. 1 (IICT-RAOKVSA Liquid-liquid extractor-2) was designed and fabricated for the de-acidification of high FFA vegetable oils (patent filed 2118 DEL 2007) and the same extractor was used along with another liquid-liquid extractor, FIG. 2 (IICT-RAOKVSA Liquid-liquid extractor-3) designed and fabricated for the enrichment of methyl ricinoleate from castor oil methyl esters.

OBJECTIVES OF THE INVENTIONS

The main object of the present invention is to provide a process for the enrichment of methyl ricinoleate (MR) from castor oil methyl esters (CME).

Another object of the present invention is to provide a process for the enrichment of methyl ricinoleate (MR) from castor oil methyl esters (CME) at ambient conditions.

Yet another object of the present invention is to provide a process for the extraction of methyl ricinoleate by a non-destructive extraction method with good yields (75 to 90%) and purity (95 to 99+%).

Yet another object of the present invention is to provide a method to retain the non-hydroxy fatty acid methyl esters of castor oil methyl esters in the vegetable oil (raffinate-1), which can be used for the preparation of biodiesel or oelochemicals.

Yet another object of the present invention is to further extract the non-hydroxy fatty acids retained in the raffinate-1 for direct use as biodiesel/oleochemicals.

Still another object of the present invention is to obtain the enriched methyl ricinoleate for use in the preparation of several derivatives without the interference of non-hydroxy fatty acids.

SUMMARY OF THE INVENTION

Accordingly the present invention provides a process for the enrichment of methyl ricinoleate from castor oil methyl ester and the said process comprising steps of:

(a) mixing the castor oil methyl esters with refined vegetable oil in a ratio of 1:1 to 1:3 to obtain a feed, (b) subjecting the above said feed to liquid-liquid extraction by using an aqueous polar solvent in a ratio of 1:1-10:1 (w/w), at a temperature of 10 to 30° C. to obtain an extract-1 and a raffinate-1, (c) desolventizing the above said extract-1, under reduced pressure, followed by drying to obtain the resultant enriched methyl ricinoleate solute-1 and recovering the solvent for further use (d) further subjecting the raffinate-1 obtained in step (b) with the an anhydrous polar solvent, at a temperature in the range of 45 to 60° C. to obtain an extract-2 and raffinate-2, followed by desolventization of the above said extract-2, under reduced pressure, to obtain the solute-2 containing recovered methyl esters with minor content of methyl ricinoleate and recycling the recovered solvent to step (d) for further use.

In an embodiment of the present invention the methyl ricinoleate content in castor oil methyl esters used in step (a) is in the range of 85-90%.

In yet another embodiment the refined vegetable oil used in step (a) is edible or non-edible oil selected from the group consisting of sunflower, soybean, jatropha and karanja oil.

In yet another embodiment the aqueous polar solvent used in step (b) and anhydrous polar solvent used in step (d) is selected form methanol and ethanol.

In yet another embodiment the water content in aqueous polar solvent used in step (b) is in the range of 5-20% (v/v).

In yet another embodiment the temperature used in liquid-liquid extraction in step (b) is preferably in the range of 20-30° C.

In yet another embodiment the purity of methyl ricinoleate (solute-1) obtained in step (c) is 95-98%.

In yet another embodiment the purity of the reprocessed enriched methyl ricinoleate is 98-99%.

In still another embodiment the raffinate (1) obtained in step (b) after desolventization, drying and on trans-esterification obtained esters used as biodiesel.

BRIEF DESCRIPTION OF THE DRAWINGS

FIG. 1 displays a Liquid-Liquid extractor-2 (Indian Patent appl. 2118 DEL2007)

Figure 1:
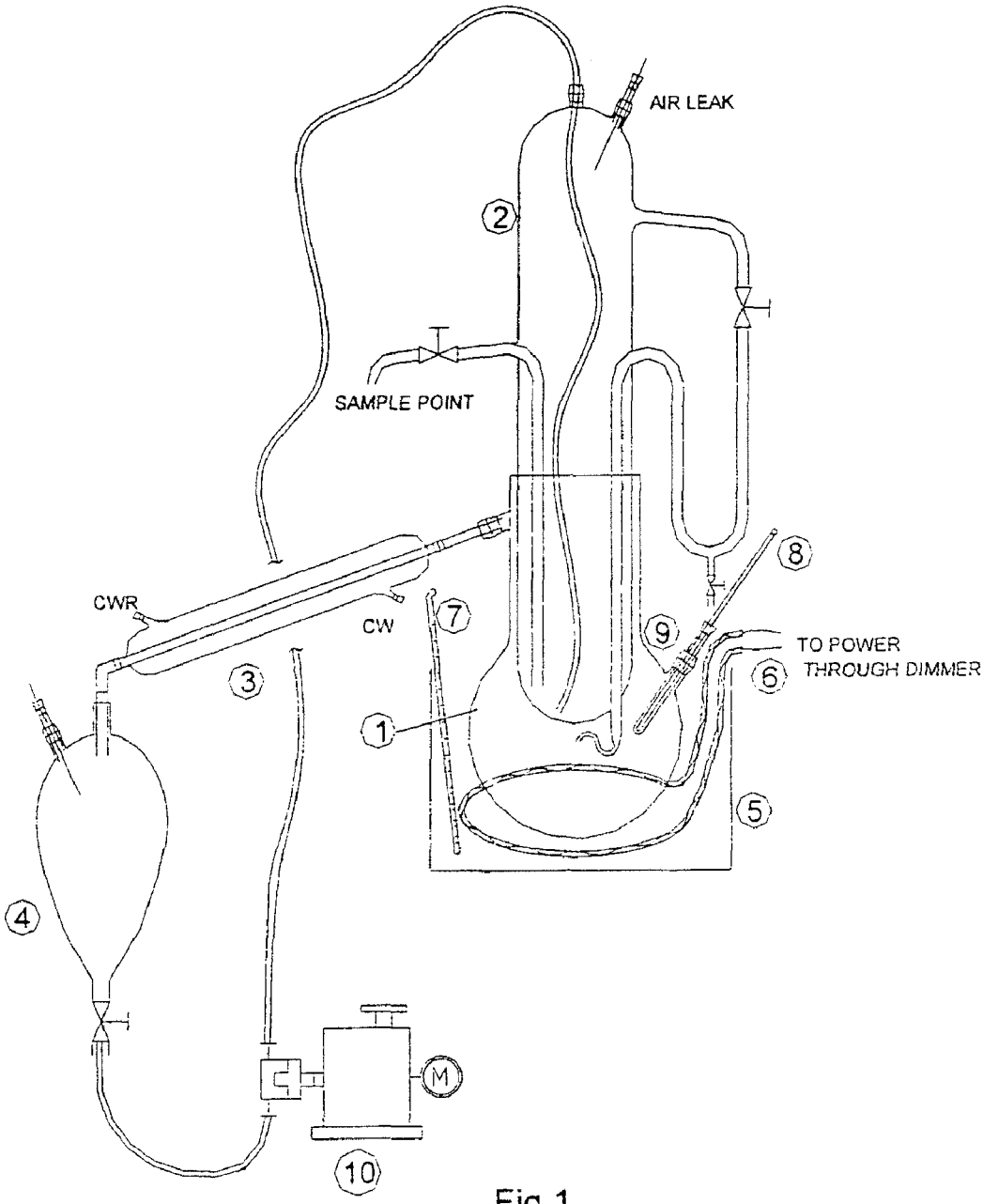
FIG. 1.

1. Extract container
2. Extractor
3. Condenser-E201
4. Solvent container
5. Oil bath
6. Heating coil
7 & 8. Thermometers
9. Thermo well
10. Metering Pump-P201

Figure 2:
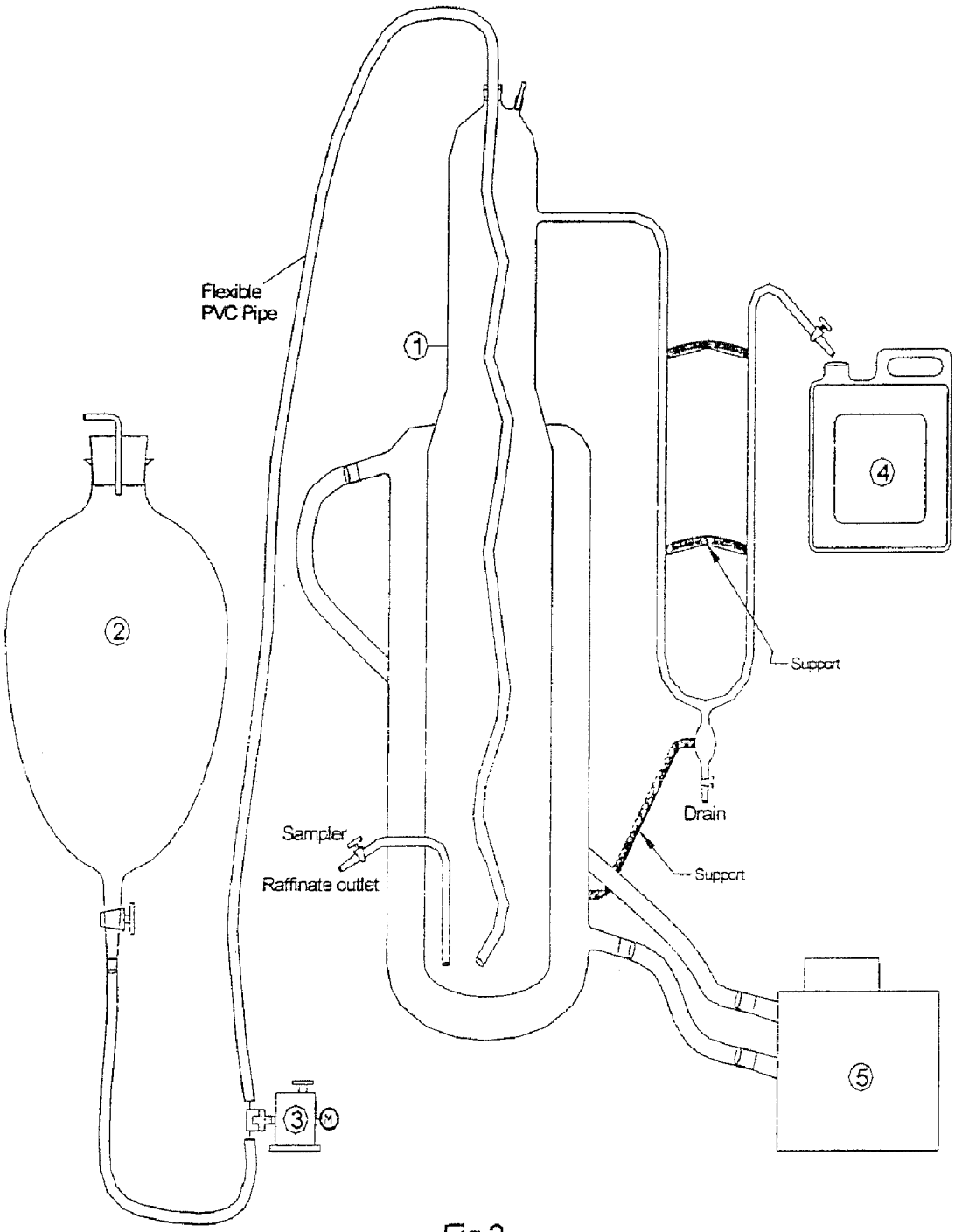

FIG. 2 displays a Liquid-Liquid extractor (IICI-RAOKVSA liquid-liquid extractor-3) made of glass with the following legend:

1. Liquid-liquid extractor
2. Solvent reservoir
3. Metering pump
4. Extract container
5. Julabo circulator FIG. 3 displays a flow chart which is a process flow diagram for the liquid-liquid extraction process for the enrichment of methyl ricinoleate from castor oil methyl esters in a ternary system.

DETAIL DESCRIPTION OF THE INVENTION

The present invention provides an efficient process for the enrichment of methyl ricinoleate from castor oil methyl esters by liquid-liquid extraction. The method consists of (a) mixing of the castor oil methyl esters in a refined normal vegetable oil in a defined proportion (feed) (b) liquid-liquid extraction (LLE) of the feed using an aqueous polar solvent to get an extract-1 and raffinate-1 (c) desolventization and drying of the extract-1 to get a solute of enriched methyl ricinoleate (d) further continuing the liquid-liquid extraction of the raffinate-1 with polar solvent at elevated temperature to get an extract-2 (e) and recycling the left over raffinate-2 in the process. The ricinoleic content in the castor oil methyl esters is 85-90%

The novel feature of the present invention is the selective liquid-liquid extraction of the methyl ricinoleate from castor oil methyl esters in a ternary system of castor oil methyl esters, refined normal vegetable oil and aqueous polar solvent.

The refined normal edible or non-edible vegetable oils used is selected from the group consisting of sunflower, soybean, jatropha, karanja. The feed consists of properly mixed and defined proportion of castor oil methyl esters and refined normal vegetable oil.

Another feature of the present invention is the selective liquid-liquid extraction of the feed in a non destructive way by aqueous polar solvent at 5-30° C., preferably at 10-20° C. there by obtaining an extract-1 containing enriched methyl ricinoleate and a raffinate-1. The aqueous polar solvent used in the LLE process contains water to the extent of 5-30% preferably 10-20% for the selective extraction of methyl ricinoleate from the feed. The extraction is carried at atmospheric pressure and below the boiling point of the aqueous polar solvent.

In yet another feature of the present invention the extract-1 is desolventized by simple distillation under reduced pressure and the obtained dried solute is the enriched methyl ricinoleate.

In yet another feature of the present invention the raffinate-1 obtained by the liquid-liquid extraction of the feed is further extracted using the same polar solvent (anhydrous) at elevated temperature 40-60° C. preferably at 45-55° C. there by obtaining an extract-2 which on desolventization and drying can directly be used as biodiesel/oleochemical and the resulting raffinate-2 can be recycled in the process.

The non-hydroxy fatty acid methyl esters of castor oil methyl esters are retained in the vegetable oil and can be used for the preparation of biodiesel or oelochemicals or reused in the process for the enrichment of methyl ricinoleate after removal of non-hydroxy fatty acid either by distillation under reduced pressure or further by liquid-liquid extraction using pure solvent. The enriched methyl ricinoleate will be useful for the preparation of several derivatives without the interference of non-hydroxy fatty acids.

The liquid-liquid extraction and separation process is carried out using simple apparatus or equipment like separating funnels, centrifuge bottles & centrifuge or using specially designed and fabricated semi continuous liquid-liquid extractors (FIG. 1 & FIG. 2)

Figure 3:
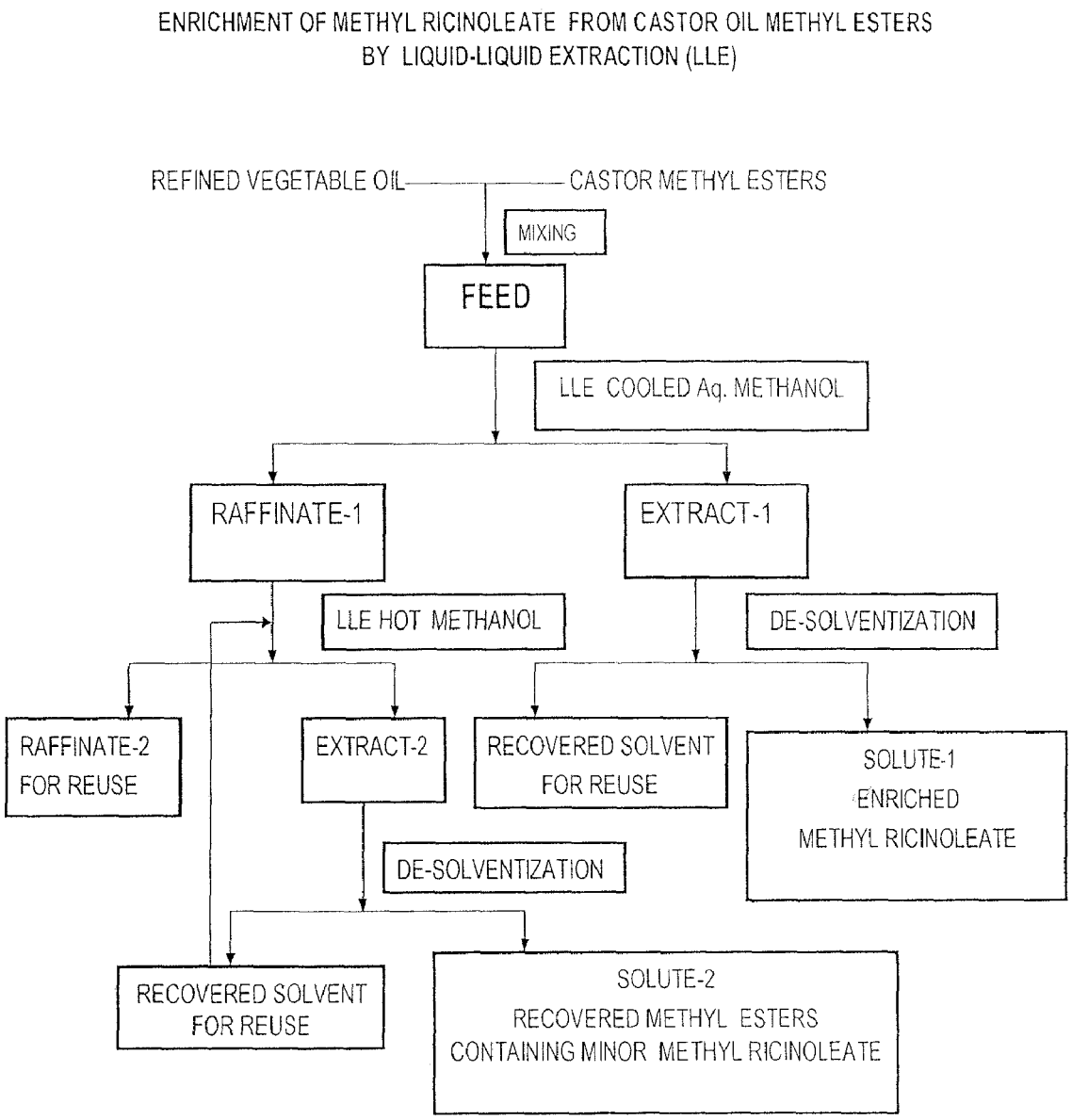

The flow chart of FIG. 3 explains the novel and simple liquid-liquid extraction process for the enrichment of methyl ricinoleate from castor oil methyl esters in a ternary system.

The following examples are intended only to further illustrate the invention and are not intended to limit the scope of the invention as defined by the claims.

EXAMPLE 1

Castor oil methyl esters (100 g) refined sunflower oil (200 g) are thoroughly mixed in a separating funnel and 10% aqueous methanol v/v (420 g) was added. The contents were shaken well and allowed to settle at room temperature around 30° C. The extract was separated and the raffinate was once again extracted with aqueous methanol (420 g) in similar way as described above. The second extract was pooled with the first one and desolventized by rotaevaporator and dried at reduced pressure at about 90-110° C. to yield about 80 g of methyl ricinoleate with 96% purity. The raffinate is also desolventized and dried as above and the yield of sunflower oil along with non-hydroxy fatty acid methyl esters retained from castor oil fatty acid methyl esters is about 218.8 g

EXAMPLE 2

Castor oil methyl esters (100 g) refined sunflower oil (100 g) are thoroughly mixed in a separating funnel and 10% aqueous methanol v/v (420 g) was added. The contents were shaken well and allowed to settle at room temperature around 30° C. The extract was separated and the raffinate was once again extracted with aqueous methanol (420 g) in similar way as described above. The second extract was pooled with the first one and desolventized by rotaevaporator and dried at reduced pressure at about 90-110° C. to yield about 70 g of methyl ricinoleate with 94% purity. The raffinate is also desolventized and dried as above and the yield of sunflower oil along with non-hydroxy fatty acid methyl esters recovered from castor oil fatty acid methyl esters is about 128 g

EXAMPLE 3

Castor oil methyl esters (1000 g) refined sunflower oil (2000 g) are thoroughly mixed in a separating funnel and pre cooled 10% aqueous methanol v/v (4220 g) was added. The contents were shaken well and allowed to settle at 20° C. The extract was separated using a metering pump and the raffinate was once again extracted with another lot of aqueous methanol (4220 g) in a similar way as described above. The second extract was pooled with the first one and desolventized by rotaevaporator and dried at reduced pressure at about 90-110° C. to yield about 724 g of methyl ricinoleate of 97% GC purity. The raffinate is also desolventized and dried as above and the yield of sunflower oil along with non-hydroxy fatty acid methyl esters retained in it is about 2202 g

EXAMPLE 4

Castor oil methyl esters (64 g) refined sunflower oil (125 g) are thoroughly mixed and taken in the IICT-RAOKVSA liquid-liquid extractor-2 {FIG. 1 (patent filed 2118 DEL 2007)} and pre cooled 10% aqueous methanol v/v (800 g) was continuously added using a metering pump at 20° C. by for a period of 5 hr and the separated upper layer was continuously collected. The extract was desolventized by rotaevaporator and dried at reduced pressure at about 90-110° C. to yield about 53 g of methyl ricinoleate with 97% purity. The raffinate is also desolventized and dried as above and the yield of sunflower oil along with non-hydroxy fatty acid methyl esters retained from castor oil fatty acid methyl esters is 132 g

EXAMPLE 5

100 g of thoroughly mixed feed containing castor oil methyl esters and refined sunflower oil in the ratio of 1:2 was taken in the liquid-liquid extractor-2 (FIG. 1) and pre cooled 10% aqueous methanol v/v (800 g) was continuously added using a metering pump at 20° C. @ 5 ml/min for a period of 4 hr and the separated extract was continuously collected. The extract was desolventized by rotaevaporator and dried at reduced pressure at about 90-110° C. to yield about 26.2 g of methyl ricinoleate with 97% purity. The raffinate is also desolventized and dried as above and the yield of sunflower oil along with non-hydroxy fatty acid methyl esters retained in it from castor oil fatty acid methyl esters is 72 g

EXAMPLE 6

100 g of the feed as in example 5 was taken is a 250 ml centrifuge bottle and thoroughly mixed with 10% aqueous methanol v/v (100 g). The contents were centrifuged using a refrigerated centrifuge at 5000 rpm, 20° C. for 30 minutes. The upper layer in the centrifuge tube was selectively removed and a fresh lot of 10% aqueous methanol v/v (100 g) was added to the centrifuge bottle and the above process was repeated thrice. All the four extracts were pooled and desolventized by rotaevaporator and dried at reduced pressure at about 90-110° C. to yield about 26.5 g of methyl ricinoleate with 97.5% purity. The raffinate is also desolventized and dried as above and the yield of sunflower oil along with non-hydroxy fatty acid methyl esters retained from castor oil fatty acid methyl esters is about 71 g.

EXAMPLE 7

A feed 1500 g containing castor methyl esters (CME), 500 g and refined jatropha oil (RJO), 1000 g in the ratio of 1:2 w/w were mixed well in a container and used in the following experiments.

100 g of the above feed containing CME and RJO in the ratio 1:2 was taken in a separating funnel and added 100 g of pre cooled 10% aqueous methanol (v/v) at 15-20° C. and shaken well and kept for standing for 30 minutes. The solvent phase was selectively removed with a metering pump and the raffinate phase is further treated in a similar way twice. The aqueous methanol extracts were pooled and passed over a bed of celite and solvent removed and dried under reduced pressure 90-110° C. and there by obtained a solute of 20.4 g of methyl ricinoleate (MR) with 96.9% GC purity. The obtained raffinate after desolventization and drying was 79.1 g

EXAMPLE 8

100 g of the feed as in example 7 was taken in a 250 ml centrifuge bottle and added 100 g of 10% aqueous methanol v/v shaken well and centrifuged in a refrigerated Centrifuge at 20° C. with 5000 rpm. After centrifuge the solvent phase was selectively separated and the raffinate phase is further treated in a similar way thrice. The four extraction phases were separately analysed by GC showing purity of MR as 98.1, 97.4, 95.5, 92.3 per cent respectively and the pooled extracts after desolventization and drying there obtained a solute of MR of 22.5 g with 95.0% GC purity. The left over raffinate after desolventization and drying was 76.7 g.

EXAMPLE 9

103 g of the feed as in example 7 is extracted continuously @ 5 ml/min. with cooled (20° C.) 10% aqueous methanol v/v in a 150 ml capacity specially designed IICI-RAOKVSA liquid-liquid extractor-2 {FIG. 1 (NE 150/2006)}. The extract-1 of 500 ml is desolventized and dried and there obtained a solute of MR 11.74 g of 95.72% GC purity. The raffinate was further extracted with another lot of cooled 500 ml of solvent mixture in a similar way and the extract-2 after desolventization and drying at reduced pressure there by obtained a solute-2 of 8.0 g showing MR 95.2% GC purity. The raffinate after desolventization and drying was 79.9 g

EXAMPLE 10

100 g of feed as in example 7 is continuously extracted with 1000 ml of cooled 10% aqueous methanol v/v (20° C.) @ 5 ml/min using a metering pump in a special designed 150 ml Liquid-liquid extractor-2 (FIG. 1) as described in example-10 and the extract after desolventization and drying was 19.0 g of MR of 97.0% GC purity. The raffinate obtained after desolventization and drying was 79.3 g.

EXAMPLE 11

CME (1 kg) showing a ricinoleic content of 88.1% by GC and having an hydroxyl value of 155 and refined jatropha Oil, AV 0.1 (2 kg) was taken in a clean and neat 10 lts container and mixed vigorously for 10-15 minutes until uniform feed is obtained and pre cooled to 20° C. using an ice bath. 6.84 kg of 10% aqueous methanol (v/v) was prepared and mixed well in another container and cooled to 20° C. in an ice bath. 3.2 kg of the cooled methanol was added to the 3 kg feed container and mixed well with hand shaking and the contents were poured in a 10 lts separating funnel and kept standing for one hour. The extract-i was selectively removed (3.12 kg) using a metering pump. The left over raffinate-i (3.02 kg) is further treated in a similar way with the remaining cooled solvent mixture (3.55 kg) and the extract-ii was also selectively removed from the raffinate-ii (2.62 kg) in a similar way as above. The extracts i&ii were pooled and solvent removed using a 10 lts rotaevaporator and further dried under reduced pressure at 90-110° C. there by obtained a solute of 0.72 kg enriched methyl ricinoleate (MR) with a purity of 95.8% by GC and the raffinate after desolventization and drying was 2.24 kg

EXAMPLE 12

100 g of the feed as in example 7 was continuously extracted with cooled 10% aqueous methanol v/v @ 4-5ml/min using a metering pump (1000 ml) in an extractor as in example 10 for a period of 4 hrs and there obtained an extract-1 after solvent removal and drying a solute 21.4 g of MR of 95% GC purity was obtained. The obtained raffinate-1 was continued extracting with pure methanol (400 ml) @ 4 ml/min at 45-55° C. for period of 2 hrs and there obtained an extract-2 after desolventization and drying obtained a solute-2 of 10.0 g showing a purity of MR 75% purity by GC. The dried left over raffinate-2 was 68.2 g.

EXAMPLE 13

50 g of enriched methyl ricinoleate of 96% GC purity obtained as in example 1 was mixed well again with 50 g of refined sunflower oil in a 250 ml centrifuge bottle and 100 ml of 10% aqueous methanol v/v was added and centrifuged at 20° C., 5000 rpm in a refrigerated centrifuge for 30 minutes. The upper solvent layer was selectively removed and the process was further repeated twice. The three extracts were pooled, solvent removed and dried as described earlier and analysed by GC. There obtained a solute of 47.3 g of methyl ricinoleate of above 99.5% purity. The raffinate after solvent removal and drying was 52.2 g which can be recycled back in the process.

EXAMPLE 14

400 g of the feed containing CME and refined sunflower oil in the ratios of 1:2 was extracted with 10% aqueous methanol (v/v) @ 7.5 ml/min with a metering pump in a specially designed and fabricated 500 ml capacity glass IICI-RAOKVSA liquid-liquid extractor-3 (FIG. 2) at 20° C. maintained with a Julabo circulator and hourly extracted samples were collected and were analysed by GC. After 12 hrs the total collected extracts were pooled (ca 5 lts), solvent was evaporated using a rotaevaporator and dried at reduced pressure 90-110° C. and obtained a solute-1 (95.1 g) showing MR purity of 96.8% by GC. The raffinate-1 was further continued extraction with pure methanol (ca. 2.5 lts) @ 7.5ml/min at 50° C. maintained with a julabo circulator for a period of 6 hrs and hourly extract samples were analysed by GC. From the methanol solubles, solvent was removed and dried as above and there obtained a solute of-2 (31.6 g) MR of 75.2% purity. After desolventization and drying there left out a raffinate-2 was of 256.9 g.

A dag layer normally appeared at the interface of the oil and the solvent phase in all the quoted examples. The dag layer that appeared at the interface of this experiment was selectively removed and dried (11.3 g) which on analysis by TLC showing similar composition as that of the feed/raffinate which is not affecting the efficiency of the extraction process.

Table-1 gives the GC analysis data of the hourly extracts and also the original castor oil methyl esters (CME) composition used in the experiments. Samples of the Refined sunflower oil, Feed containing CME and sunflower oil & Raffinate-2 were separately transesterified using sodium methoxide containing methanol as per the known methods and the isolated methyl esters were also analysed by GC under similar conditions. The data indicates the progress and the efficiency of the extraction process in fractionating the CME into a major high pure fraction and a minor low pure fraction in a non destructive way, thus illustrating in detail of our claims in a ternary liquid-liquid extraction process.

TABLE 1

ENRICHMENT OF METHYL RICINOLEATE FROM CASTOR OIL METHYL ESTERS BY LLE GC % COMPOSITION DATA OF THE FEED, EXTRACT, & RAFFINATE OF EXAMPLE-14
+dihydroxy stearic 0.4 detected but not in extracts

| SAMPLE | 16:0 | 18.0 | 18:1 | 18:2 | RICINOLEIC |
|---|---|---|---|---|---|
| CME+ | 1.3 | 1.4 | 3.8 | 5.0 | 88.1 |
| RSFO* | 5.6 | 2.6 | 47.4 | 44.4 | — |
| FEED* | 4.9 | 2.6 | .39.3 | 38.4 | 14.8 |

TABLE 1-continued

ENRICHMENT OF METHYL RICINOLEATE FROM CASTOR OIL METHYL ESTERS BY LLE GC % COMPOSITION DATA OF THE FEED, EXTRACT, & RAFFINATE OF EXAMPLE-14
+dihydroxy stearic 0.4 detected but not in extracts

| SAMPLE | 16:0 | 18.0 | 18:1 | 18:2 | RICINOLEIC |
|---|---|---|---|---|---|
| 10% AQ. MEOH EXTRACTS 20° C. | | | | | |
| $1^{ST}$ HR | — | — | 1.0 | 1.2 | 97.8 |
| $3^{RD}$ HR | — | — | 1.3 | 1.9 | 96.8 |
| $5^{TH}$ HR | — | — | 1.5 | 2.2 | 96.3 |
| $7^{TH}$ HR | — | — | 1.9 | 2.6 | 95.5 |
| $8^{TH}$ HR | — | — | 1.9 | 2.6 | 95.5 |
| $9^{TH}$ HR | | | 2.0 | 2.7 | 95.3 |
| $10^{TH}$ HR | — | — | 2.2 | 3.0 | 94.8 |
| $11^{TH}$ HR | — | — | 2.5 | 3.3 | 94.2 |
| $12^{TH}$ HR | — | — | 2.5 | 3.2 | 94.3 |
| 12 HRS AQ. MEOH EXTRACTS POOLED | — | — | 1.1 | 2.1 | 96.8 |
| HOT MEOH EXTRACTS 50° C. | | | | | |
| $1^{ST}$ HR | 1.5 | 1.5 | 6.0 | .7.8 | 83.2 |
| $2^{ND}$ HR | 2.0 | 2.0 | 7.9 | 9.6 | 78.5 |
| $3^{RD}$ HR | 2.3 | 2.7 | 9.0 | 11.1 | 74.9 |
| $4^{TH}$ HR | 2.5 | 1.0 | 12.2 | 11.8 | 72.5 |
| $5^{TH}$ HR | 3.4 | 3.9 | 13.3 | 15.9 | 63.5 |
| $6^{TH}$ HR | 3.9 | 1.5 | 20.0 | 17.4 | 57.1 |
| HOT MEOH EXTRACTS POOLED | 2.4 | 0.9 | 11.2 | 10.3 | 75.2 |
| RAFFINATE-2* | 5.8 | 2.9 | 46.8 | 44.7 | — |

*transesterified and isolated methyl esters

Advantages

The main advantages of the present invention are:

1. The fractionation of castor methyl esters using a single aqueous polar solvent in a ternary system of castor oil methyl esters (CME), any conventionally refined normal vegetable oil either edible or non edible oil at ambient conditions using simple extraction and separation equipment and protocols resulting in enriching methyl ricinoleate to the extent of 95-99% with good yields (75-90%) and is highly promising for commercial exploitation.
2. Methyl ricinoleate is stable and storable for longer duration of time and is a better source for many of the ricinoleic based useful Industrial products.
3. The selective removal of the non hydroxyl fatty acids containing minor amounts of methyl ricinoleate supplement to biodiesel/oleochemical Industry.
4. This invention gives a double benefit of enrichment of hydroxyl ester from castor oil methyl esters on one hand and on the other hand the non hydroxyl ester can be utilized as biodiesel/oleochemical, a renewable, non-petroleum-based source of chemical feedstock for value addition products

We claim:

1. A process for the enrichment of methyl ricinoleate from castor oil methyl ester and the said process comprising steps of:

(a) mixing the castor oil methyl esters with refined vegetable oil in a ratio of 1:1 to 1:3 to obtain a feed, (b) subjecting the above said feed to liquid-liquid extraction by using an aqueous polar solvent in a ratio of 1:1 to 10:1 (w/w), at a temperature of 10 to 30° C. to obtain an extract-1 and a raffinate-1, (c) desolventizing the above said extract-1, under reduced pressure, followed by drying to obtain the resultant enriched methyl ricinoleate (solute-1) and recovering the solvent for further use, (d) further subjecting the raffinate-1 obtained in step (b) with the an anhydrous polar solvent, at a temperature in the range of 45 to 60° C. to obtain an extract-2 and raffinate-2, followed by desolventization of the above said extract-2, under reduced pressure, to obtain the solute-2 containing recovered methyl esters with minor content of methyl ricinoleate and recycling the recovered solvent to step (d) for further use.

2. A process according to claim 1, wherein the methyl ricinoleate content in castor oil methyl esters used in step (a) is in the range of 85-90%.

3. A process according to claim 1, wherein the refined vegetable oil used in step (a) is edible or non-edible oil selected from the group consisting of sunflower, soybean, jatropha and karanja oil.

4. A process according to claim 1, wherein the polar solvent used in step (b) and step (d) is selected form methanol and ethanol.

5. A process according to claim 1, wherein the water content in aqueous polar solvent used in step (b) is in the range of 5-20% (v/v).

6. A process according to claim 1, wherein the temperature used in liquid-liquid extraction in step (b) is preferably in the range of 20-30° C.

7. A process according to claim 1, wherein the purity of methyl ricinoleate (solute 1) obtained in step (c) is 95-98%.

8. A process according to claim 1, wherein the purity of the reprocessed enriched methyl ricinoleate is 98-99%.

9. A process according to claim 1, wherein the raffinate (1) obtained in step (b) after desolventization, drying and on trans-esterification obtained esters used as biodiesel.

* * * * *